US008684224B2

(12) United States Patent
House

(10) Patent No.: US 8,684,224 B2
(45) Date of Patent: Apr. 1, 2014

(54) CANISTER STYLE PACKAGE WITH OPENING FEATURE

(75) Inventor: Richard F. House, Albuquerque, NM (US)

(73) Assignee: Graphic Packaging International, Inc., Marietta, GA (US)

( * ) Notice: Subject to any disclaimer, the term of this patent is extended or adjusted under 35 U.S.C. 154(b) by 70 days.

(21) Appl. No.: 13/185,576

(22) Filed: Jul. 19, 2011

(65) Prior Publication Data

US 2011/0309080 A1 Dec. 22, 2011

Related U.S. Application Data

(63) Continuation of application No. PCT/US2010/022324, filed on Jan. 28, 2010.

(60) Provisional application No. 61/149,492, filed on Feb. 3, 2009.

(51) Int. Cl.
*B65D 5/00* (2006.01)
*B65D 3/26* (2006.01)
*B65D 17/00* (2006.01)

(52) U.S. Cl.
USPC ..... 220/677; 206/830; 229/201; 229/206

(58) Field of Classification Search
USPC ..... 220/677, 266, 265; 206/830; 229/200, 229/201, 206, 205
See application file for complete search history.

(56) References Cited

U.S. PATENT DOCUMENTS 2,795,366 A * 6/1957 Magill ..... 229/201
3,101,885 A * 8/1963 Walsh ..... 229/201
3,109,576 A * 11/1963 Karl ..... 229/201
3,506,183 A * 4/1970 Leezer et al. ..... 229/201
3,940,496 A * 2/1976 Turpin et al. ..... 426/123
4,091,929 A * 5/1978 Krane ..... 229/101.1
5,487,506 A * 1/1996 Drummond et al. ..... 229/202
2005/0051461 A1* 3/2005 Bryant ..... 206/769
2006/0254942 A1* 11/2006 Cargile, Jr. ..... 206/427
2007/0234667 A1* 10/2007 Lubker et al. ..... 52/408

FOREIGN PATENT DOCUMENTS

JP 2005-041515 A 2/2005
JP 2005-219319 A 8/2005
JP 2005-333802 A 12/2005
WO WO 03/039201 A1 5/2003

OTHER PUBLICATIONS

International Search Report and Written Opinion dated Aug. 17, 2010 for PCT/US2010/022324.

* cited by examiner

*Primary Examiner* — Anthony Stashick
*Assistant Examiner* — Don M Anderson
(74) *Attorney, Agent, or Firm* — Womble Carlyle Sandridge & Rice, LLP

(57) ABSTRACT

A cylindrical tubular canister package has a body and ends. A tear-away strip is formed in the body by a pair of spaced partial cuts on the outside of the body. A thin strip of tear tape is secured to the inside of the body underlying and extending along the tear-away strip. A tab is formed at one end of the tear away strip. The canister package is opened by grasping the tab and pulling away from the canister body, which causes the tear-away strip to be severed from the body to open up the canister. The strip may extend axially, circumferentially, spirally, or otherwise along the canister body.

33 Claims, 6 Drawing Sheets

CANISTER STYLE PACKAGE WITH OPENING FEATURE

CROSS-REFERENCE TO RELATED APPLICATIONS

This application is a continuation application of prior PCT Application No. PCT/US2010/022324, filed Jan. 28, 2010, entitled "Canister Style Package With Opening Feature," which PCT application claims the benefit of U.S. Provisional Application No. 61/149,492, filed on Feb. 3, 2009.

Incorporation by Reference

The entire disclosures of PCT Application No. PCT/US2010/022324, filed Jan. 28, 2010, and U.S. Provisional Application No. 61/149,492, filed Feb. 3, 2009, are incorporated by reference as if set forth in their entireties.

TECHNICAL FIELD

This disclosure relates generally to packaging and more specifically to tubular or canister style packages of the type used to package biscuit dough and similar products.

BACKGROUND

Canister packages are generally cylindrical tubular containers used to package a variety of foods such as, for example, biscuit dough, cookie dough, frozen juices, and the like. Canister packages can be formed from paperboard blanks with the use of a canister forming machine such as those available from Paper Machinery Corporation (PMC) and others. In such machines, a blank is rolled into a cylindrical tubular shape and its edges secured together to form the body of the canister. A disc-shaped end plate, which may be made, for example, of metal, plastic, or paperboard, is secured to one end of the canister body. The canister may then be filled with product, whereupon the other end of the body is closed and sealed with another disc-shaped end plate. Some canister packages are known as "barrier packages" because they include coatings that keep moisture in or out and that prevent the migration of oxygen into the canister.

Canister packages can be opened in a variety of ways to access the product inside. In the case of biscuit dough, for example, it is not practical to remove the dough from one of the ends of the canister. Thus, it is customary for the body of a dough canister to be formed as a spiral roll that is ruptured by applying targeted force to the body or by whacking the canister body on the edge of a counter or the like. The partially expanded dough inside the canister applies outward pressure to the walls of the canister so that the body of the canister tends to pop open when a small rupture is created to provide access to the dough product inside. Some dough recipes, however, do not result in dough that expands and applies outward pressure to a canister. Thus, the traditional opening techniques such as whacking the body of the canister on the edge of a counter or applying targeted force will not cause the canister to pop open.

Some canister packages are openable by removal of one of their ends either with a can opener or by removal of a thin plastic strip wedged between the crimped lip of the end plate and the peripheral edge of the canister body. While opening a canister package from an end is satisfactory for removing certain foods such as frozen juices, it is not practical for removing sticky or partially expanded food such as dough, which will not slide easily out of the opened canister. Further, removing an end cap from the canister leaves the product completely recessed in the canister body. It is not uncommon that a spoon or other utensil is required to scoop product from the canister body, which can be messy and irritating.

A need therefore exists for an improved canister package that can be opened easily and reliably, even for non-expanded contents, without the need to whack the can on a hard surface or apply targeted pressure to the body of the can, and that provides more convenient access to product than do canister packages that are opened at an end. It is to the provision of such a canister package that the present disclosure is primarily directed.

SUMMARY

Briefly described, a canister style package for packaging foods such as biscuit dough includes a cylindrical tubular body closed at its ends with end caps to contain the product therein. The body of the canister is formed from a generally rectangular paperboard blank that may include an impervious barrier coating on an interior surface. The blank is rolled into a tube and its edges secured together in a PMC style canister forming machine. An opening feature is built into the body of the canister to allow the body of the canister to be opened up for removing product inside. The opening feature may include a thin strip of tear tape applied to the inside surface of the canister body extending either in an axial direction along the body or in a circumferential direction around the body. The outside of the canister body preferably is provided with a tear-away strip defined by partial cuts or other lines of weakness on either side of the tear tape and a tab is formed at one end of the strip with the tear tape extending onto the tab. Because the tear tape is applied to the inside surface of the canister body and the partial cuts on the outside of the container body extend only partially through the paperboard, the integrity of the moisture and oxygen barrier formed by the canister body is maintained.

When it is desired to open the canister to access and remove product inside, the tab is grasped and pulled away from the canister along the direction of the tear tape. This causes the tear-away strip of the container body to be torn away from the body, thereby breaching and opening up the canister body. In one embodiment, doors or flaps are formed in the canister body that can be swung open after the strip is torn away. In another, one end portion of the container can be removed after the container body is severed by removing the tear-away strip.

Thus, an improved canister package is now provided that successfully addresses problems with prior art canister packages by being easily and reliably opened without the need to apply targeted pressure to the container or to whack it on the edge of a counter. Once opened, the canister provides direct access to product inside so that it can be removed more easily than with canisters that open at their ends. These and other features and advantages of the canister package will be come more apparent upon review of the detailed description set forth below, when taken in conjunction with the accompanying drawing figures, which are briefly described as follows.

DETAILED DESCRIPTION

Figure 1:
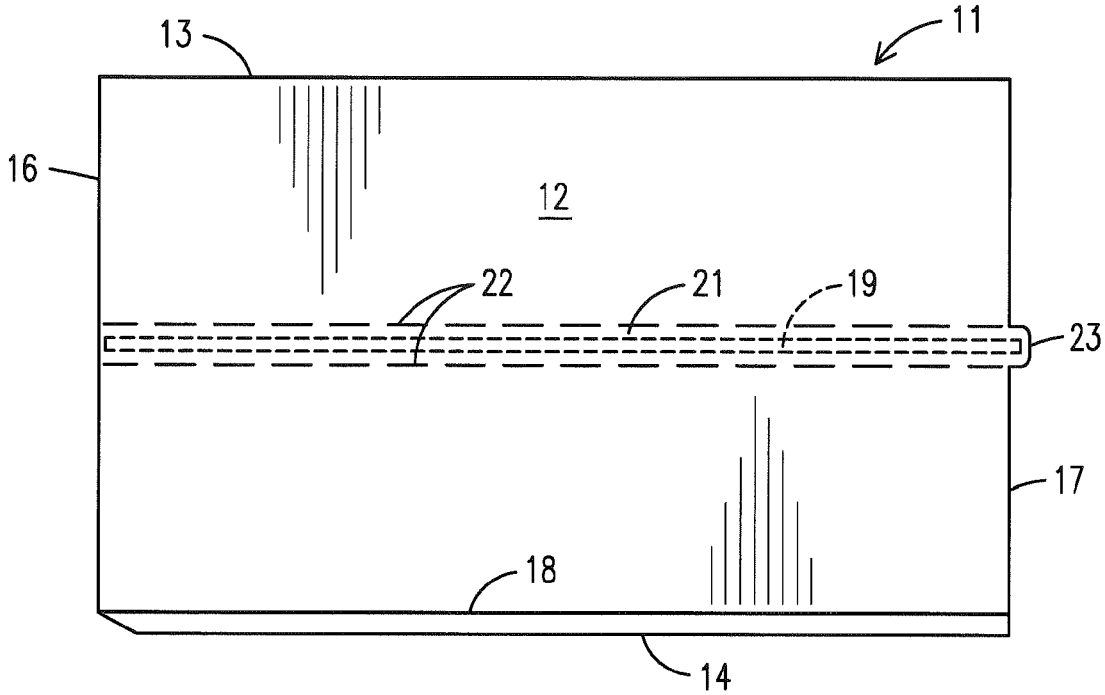
FIG. 1 is a top plan view of a paperboard blank from which a canister according to a first embodiment may be formed.

Referring now in more detail to the drawing figures, wherein like reference numerals indicate like parts throughout the several views, FIG. 1 shows a paperboard blank from which a canister package according to a first embodiment may be formed. The blank 11 is generally rectangular in shape and includes an outside surface 12 (i.e. the surface that will become the outside surface of the canister body formed from the blank 11), a top edge 13, a bottom edge 14, a left edge 16, and a right edge 17. A fold line 18 is formed along the bottom edge portion for purposes described in more detail below. The inside surface of the blank 11 may be coated with an impervious material such as a polyethylene coating to provide a barrier against moisture and oxygen.

A thin strip of tear tape 19 is secured to the inside surface of the blank 11 (i.e. the surface not visible in FIG. 1 that will become the inside surface of the canister) and extends along its length from a location proximate the left edge 16 to the right edge 17. The tear tape may be secured to the inside surface in any appropriate manner. For example, the tear tape can have an adhesive surface on one side with the adhesive surface being pressed onto the inside surface of the blank in the forming machine. Alternatively, the tear strip may be of the type impregnated with hot melt adhesive, in which case the tear strip may be applied to the inside surface of the blank with a heated roller before it is rolled into a tube. A separate adhesive also may be used, as may a strip of tape applied over the tear tape to secure the tear tape to the blank. The tear tape can be applied to each blank individually, or more preferably applied to the paperboard web from which blanks are later cut. In either case, a tab 23 is formed on the right edge 17 of the blank (it also may be formed in the left edge 16 or both if desired) and an end of the tear tape 19 extends onto the tab 23. A tear-away strip 21 is formed on the outside surface 12 of the blank 11 by a pair of spaced parallel partial cuts 22 that extend only partially through the material of the paperboard blank. For example, the partial cuts may extend about half way through the material of the blank, in which case, they may be referred to as "50% Cuts." Ensuring that the partial cuts 22 extend only partially through the paperboard material maintains the integrity of the barrier formed by any coatings on the interior surface of a canister formed from the blank, as does application of the tear tape to the inside surface.

Figure 2:
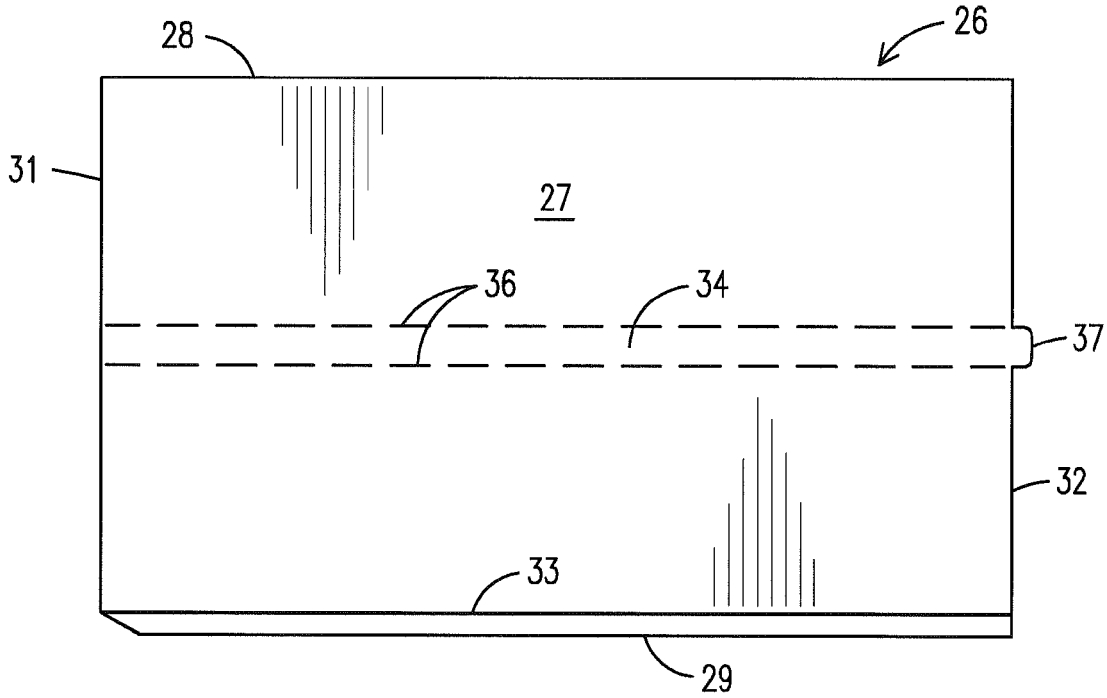
FIG. 2 is a top plan view of a paperboard blank from which a canister according to a second embodiment may be formed.

FIG. 2 illustrates a paperboard blank from which a canister package according to a second embodiment may be formed. The blank 27 is similar in most respects to the blank 11 of FIG. 1 in that it includes an outside surface 27, an inside surface (not visible), a top edge 28, a bottom edge 29, a left edge 31, a right edge 32, and a fold line 33. A tear-away strip 34 is formed along the blank by a pair of partial cuts 36, which may be 50% cuts or cuts of another selected depth. The tear-away strip extends from the left edge 31 of the blank toward the right edge 32 and terminates at the right edge 32 in a tab 37. In the embodiment of FIG. 2, however, no tear tape strip is applied to the inside surface of the blank as in FIG. 1. Instead, a canister formed from the blank of FIG. 1 is opened by tearing away the tear strip layer of the paperboard, as detailed below.

Figure 3:
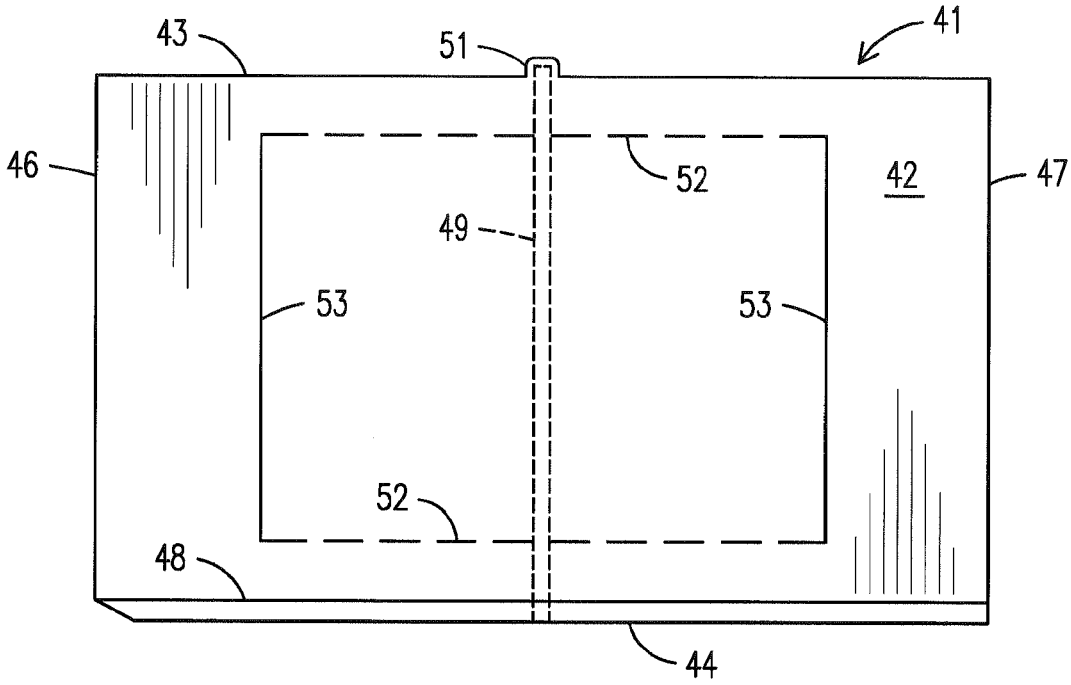
FIG. 3 is a top plan view of a paperboard blank from which a canister according to a third embodiment may be formed.

FIG. 3 illustrates a paperboard blank from which a canister package according to a third embodiment may be formed. The blank 41 has an outside surface 42, a top edge 43, a bottom edge 44, a left edge 46, a right edge 47, and a fold line 48. A strip of tear tape 49 is secured to the inside surface of the blank 41 and extends from the bottom edge 44 to the top edge 43. The top edge 43 of the blank 41 is formed with a tab 51, and the strip of tear tape 49 extends onto the tab 51 as shown. The tear tape is located approximately mid-way between the left and right edges of the blank in the illustrated embodiment, but this is not a requirement or a limitation. In the embodiment of FIG. 3, there is no tear-away strip formed of partial cuts overlying the tear tape as in other embodiments; however, such a tear-away strip may be provided if desired. Spaced apart partial cuts 52 are formed in the outside surface 42 of the blank 41 and each partial cut extends transversely across the tear tape 49 to positions equidistant (or non-equidistant) from the tear tape on each of its sides. Fold lines 53, which may be formed as score lines in the paperboard material, extend between corresponding ends of the partial cuts 52. The partial cuts 52 and the fold lines 53 together form a generally rectangular shape in the outside surface of the blank 41.

Figure 4:
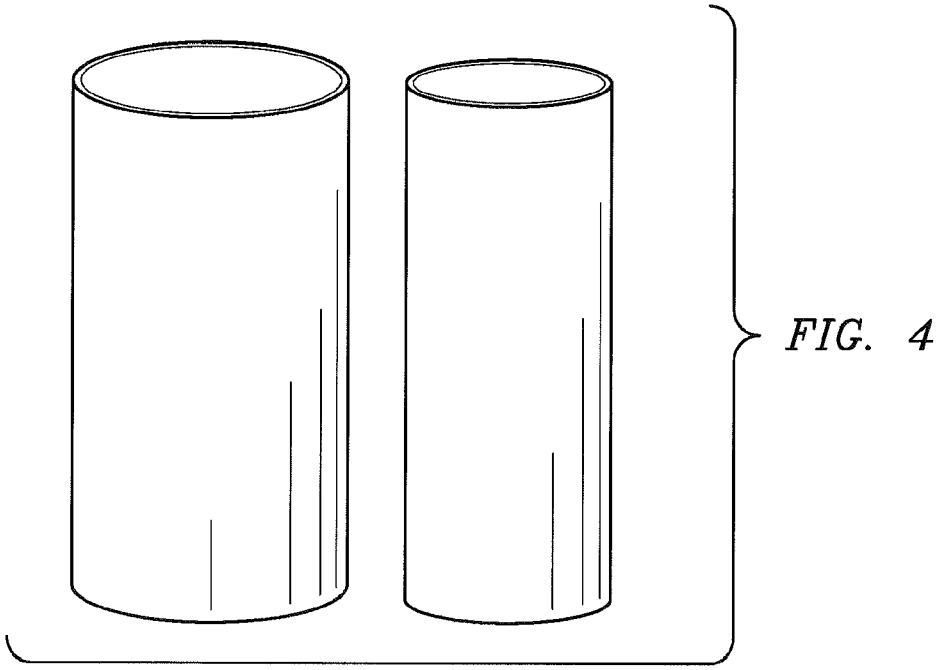
FIG. 4 illustrates two cylindrical canister bodies formable from blanks such as those of FIGS. 1 through 3, each body having a different length and diameter.
Figure 5:
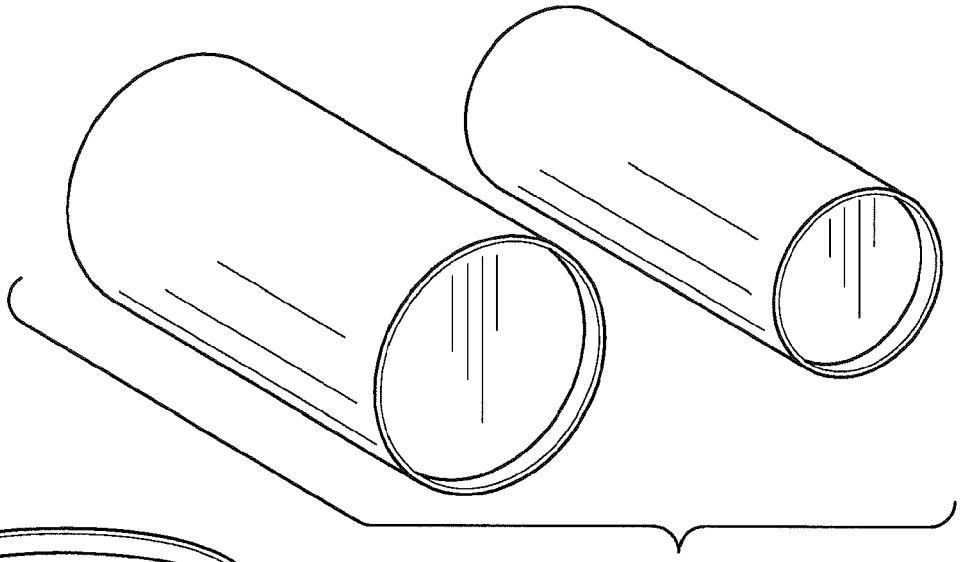
FIG. 5 illustrates the ends of the canister bodies of FIG. 4 showing the closure of one end with end caps.

FIGS. 4 and 5 illustrate how a rectangular blank of paperboard material, such as the blanks in FIGS. 1-3, may be formed into cylindrical tubular canister packages according to the disclosure. Such canister packages may be formed on a PMC or like paper canister forming machine. Generally, the blank is rolled into a tube from its left edge to is right edge (or vice versa) and its edges are sealed together to form a generally cylindrical tubular shape as shown in FIG. 4 (wherein canister packages of two different sizes are illustrated). As shown in FIG. 5, the bottom end of the cylindrical tube may be sealed with a bottom cap. In this case, the bottom cap also is a rimmed circular piece of paperboard inserted into the bottom end of the cylindrical tube, where it is attached by folding the bottom edge of the tube inwardly along a fold line such as fold line 18 in FIG. 1 to overlie the rim of the bottom cap. Adhesive or other means of securing and sealing the bottom cap in place may be used. The canister can then be filled with product, whereupon the top of the canister is closed off and sealed with a top cap. The top and bottom caps may be applied in any of a variety of ways as will be recognized by those of skill in the art. Further, the caps can be formed of paperboard, plastic, metal, or any other suitable material.

Figure 6:
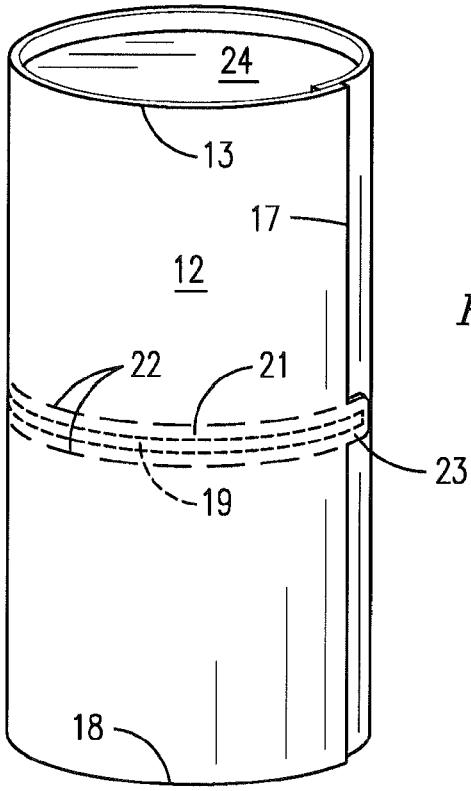
FIG. 6 is a perspective view of a canister package according to a first embodiment shown prior to opening.
Figure 7:
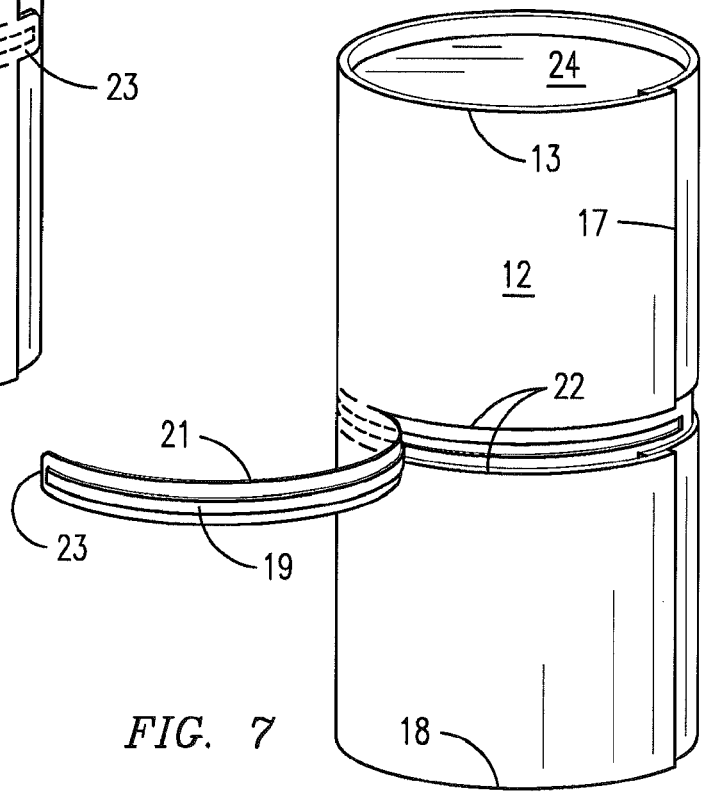
FIG. 7 is perspective view of the canister package of FIG. 6 as it appears after opening.

FIGS. 6 and 7 illustrate a canister package formed from the blank of FIG. 1 and further illustrate a method of opening the canister package according to the present disclosure. In FIG. 6, the blank of FIG. 1 has been rolled and capped as described above. The outside surface 12 of the blank forms the cylindrical outer wall of the canister body. Right edge 17 and tab 23 overlap the left edge 16 and the right edge 17 is adhered and sealed to the left edge 16. A top cap 24 closes the top end of the canister and a bottom cap (not visible) closes the bottom end. The strip of tear tape 19 on the inside surface of the canister is shown in phantom line and the partial cuts 22 forming the tear-away strip 21 on the outside surface of the canister overlying the tear tape are visible. In this embodiment, the tear tape and tear-away strip extend circumferentially around the mid section of the canister package and the tab 23 is exposed for grasping by a user. Of course, the tear tape and tear-away strip can be located other than around the mid-section, such as, for instance adjacent the top edge 13 or the fold line 18 at the bottom of the package.

To open the canister package shown in FIG. 6, a user grasps the tab 23 and begins to pull the tear-away strip away from the body of the canister, as is illustrated in FIG. 7. As the tear-away strip is pulled around the canister body, the outer ply of paperboard of the canister body is severed along the partial cuts 22 and the tear tape 19 tears away or tears a strip through the inner ply of paperboard as shown to open up the canister around its periphery. When the tear-away strip and tear tape are torn away completely (or partially) around the perimeter of the canister body, the upper portion of the canister becomes severed (or partially severed) from the lower portion of the canister and can be removed (or displaced) to permit access to the contents of the canister. For less firm or loose contents, the tear-away strip and tear tape may be located adjacent the top edge of the canister body so that only the top cap and a small section of the body is removed. The contents can then be poured out of the canister. For firm and/or sticky contents such as dough, the tear-away strip likely is best located at the center portion of the canister as shown in FIG. 7.

Figure 8:
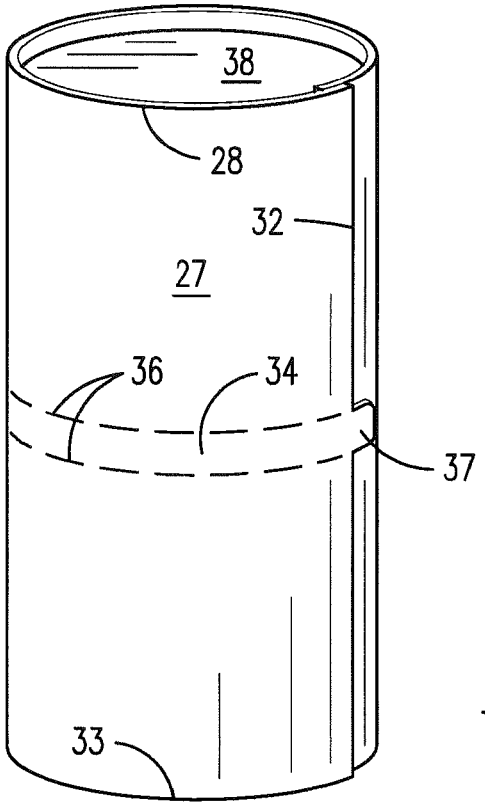
FIG. 8 is a perspective view of a canister package according to a second embodiment shown prior to opening.
Figure 9:
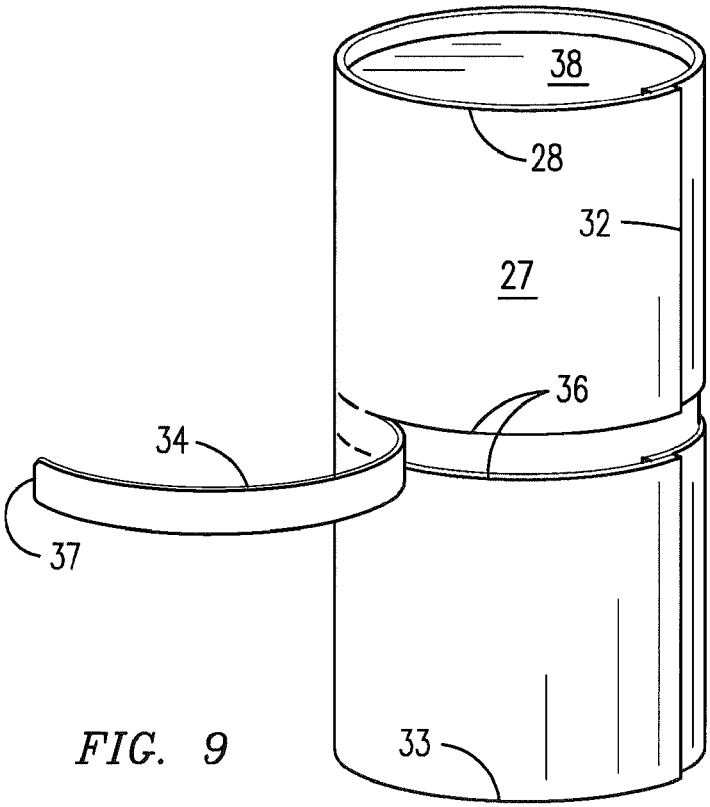
FIG. 9 is a perspective view of the canister package of FIG. 8 as it appears after partial opening.

FIGS. 8 and 9 illustrate a canister package formed from the blank of FIG. 2 and further illustrate opening of the canister of this embodiment. The canister is similar in most respects to the canister of FIGS. 6 and 7 and has a right edge 32 that overlaps and is adhered to the left edge to form a cylindrical tubular body that is capped by a top cap 38 and a bottom cap (not visible). A tear-away strip 34 is formed by partial cuts 36 that extend around the periphery of the canister body proximate it mid-section. To open the canister (FIG. 9) a user grasps the tab 37 at the end of the tear-away strip and pulls it away from the canister body. Because the partial cuts extend only partway through the paperboard material of the canister body, this causes the outer layer or ply of the tear-away strip to delaminate and separate from the inner layer or ply, leaving the inner layer or ply in place. While this does not sever the canister into upper and lower halves, it substantially weakens the canister body along the location of the tear-away strip. If the contents of the canister package exert outward pressure, such as traditional biscuit dough, the weakening causes the package to burst open to provide access to the contents. For contents that do not exert outward pressure, such as some dough recipes, frozen fruit juice, and the like, the embodiment of FIGS. 8 and 9 might not be the optimum solution.

Figure 10:
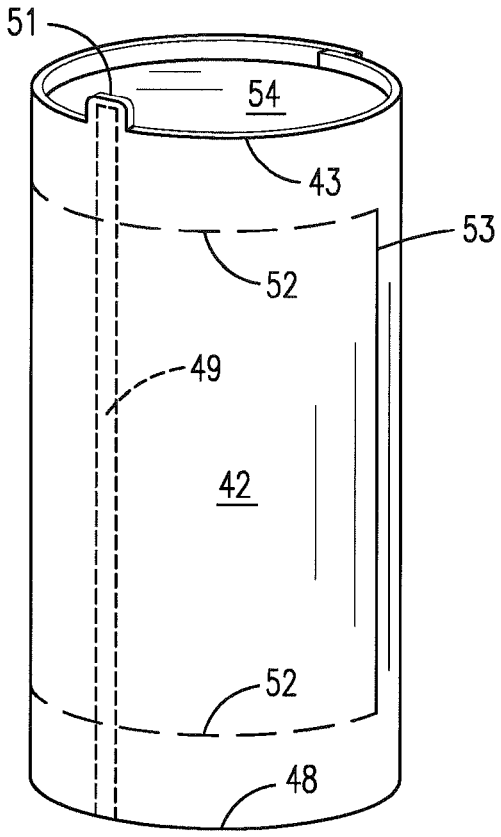
FIG. 10 is a perspective view a canister package according to a third embodiment shown prior to opening.
Figure 11:
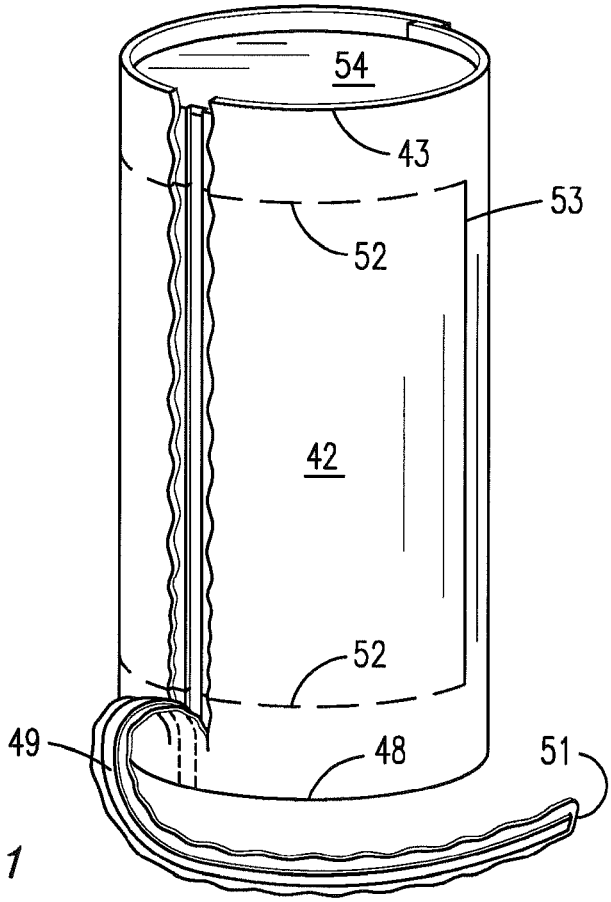
FIG. 11 is a perspective view of the canister package of FIG. 10 as it appears after partial opening.
Figure 12:
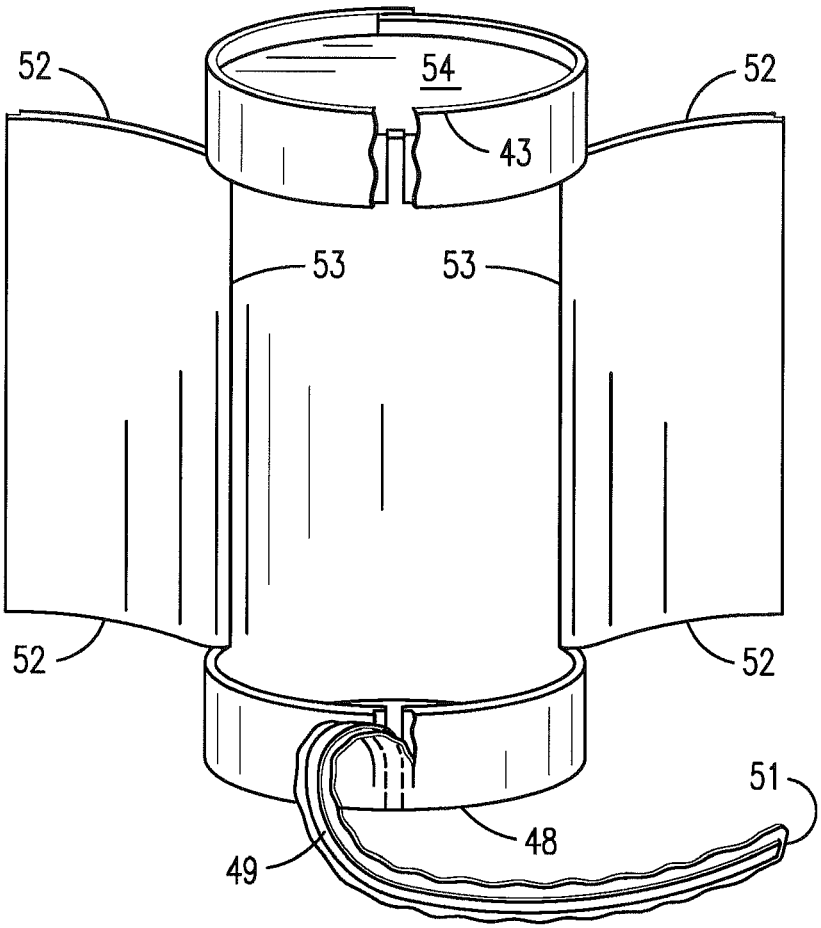
FIG. 12 is a perspective view of the canister package of FIG. 10 as it appears after having been completely opened.

FIGS. 10-12 illustrate an embodiment of a canister package formed from the blank of FIG. 3. The outside surface 42 of the blank forms the cylindrical outside surface of the canister body and the left and right ends (not visible) are overlapped and adhered together. The top of the canister body is closed by a top cap 54 and the bottom by a bottom cap (not visible). A strip of tear tape 49 is secured to the inside surface of the canister body and extends axially from tab 51 to the fold line 48 at the bottom of the canister body. Partial cuts 52 and fold lines 53 (only one of which is visible in FIG. 10) form an arched rectangular shape around a portion of the outside surface of the canister body. To open the canister package, the tab 51 is grasped and pulled downwardly away from the canister body as illustrated in FIG. 11. This causes the tear tape on the inside surface of the canister body to sever the paperboard along an axial line and thus to open a slot in the canister along this line.

With the tear tape stripped away to form the slot, the partial cuts 52 and fold lines 53 on either side of the open slot form a pair of opposed flaps that each is severable along its partial cut lines and foldable along its fold line. In this regard, FIG. 12 illustrates the final step in opening up the canister package of this embodiment. More specifically, each flap is gripped by a user and pulled away from the canister body. This causes the flaps to separate from the canister body along their partial cuts. As the flaps are pulled further, they bend or hinge along their respective fold lines 53 as illustrated in FIG. 12 to open the canister fully to provide access to its contents. This embodiment might be an appropriate choice for loose items such as donut holes, nuts, cookies, and other foods that would tend to fall out of the canister if a top portion were removed as in prior embodiments. The opened canister as shown in FIG. 12 also may function as a serving container with appropriate support.

The invention has been described within the context of preferred embodiments and methodologies considered by the inventors to represent the best mode of carrying out the invention. However, these preferred embodiments should not be construed as limiting the scope of the invention. In fact, a wide variety of additions, deletions, and modifications to the illustrated embodiments might well be made by those of skill in the art without departing from the spirit and scope of the invention as set forth in the claims. For example, while tear-away strips extending axially and peripherally have been illustrated, they may just as well extend at an angle on the blank so as, for example, to extend spirally around the formed canister package. In such an embodiment, pulling the tear-away strip might open the can spirally around its outer surface. Other configurations and orientations of the tear-away strip and tear tape are contemplated and within the scope of the invention.

What is claimed is:

1. A canister package having:

a canister body and ends, the body being selectively severable along a defined path to open the package;

a tear-away strip defined in the canister body extending along the defined path;

partial cuts defined in the canister body that extend transversely across the canister body from the tear-away strip to a fold line; and at least one flap defined in the canister body by the partial cuts and the fold line prior to the tear-away strip being at least partially separated from canister body, the at least one flap limited in size by the fold line, the at least one flap is foldably connected to the canister body along the fold line and severable along the partial cuts when the tear-away strip is at least partially separated from the canister body, the at least one flap being positionable between a closed position wherein the at least one flap is adjacent the tear-away strip and an open position allowing access to the interior of the canister package upon tearing of tear-away strip.

2. A canister package as claimed in claim 1 and further comprising a strip of tear tape extending along the defined path for severing the canister body when the tear tape is pulled away from the canister.

3. A canister package as claimed in claim 2 and further comprising a tear-away strip defined in the canister body at least partially overlying the strip of tear tape.

4. A canister package as claimed in claim 1 and wherein the defined path extends axially along the canister.

5. A canister package as claimed in claim 1 and wherein the fold line is a line of weakening formed in the canister body prior to the tear-away strip being at least partially separated from the canister body.

6. A canister package comprising:

a substantially tubular body having an outer surface and an inner surface;

a bottom end cap closing a bottom end of the substantially tubular body;

a top end cap closing a top end of the substantially tubular body;

a tear-away strip defined in the tubular body and extending in a predetermined direction along the tubular body;

partial cuts defined in the tubular body that extend transversely across the tubular body from the tear-away strip to a fold line;

at least one flap being positionable between a closed position wherein the at least one flap is adjacent the tear-away strip and an open position allowing access to the interior of the canister package upon tearing of tear-away strip, the at least one flap is defined in the tubular body of the canister by the partial cuts and the fold line prior to the tear-away strip being at least partially separated from the tubular body, the at least one flap limited in size by the fold line, the at least one flap is foldably connected to the tubular body along the fold line and severable along the partial cuts when the tear-away strip is at least partially separate from the tubular body;

removal of the tear-away strip at least partially opening the canister package to provide access to contents therein.

7. A canister package as claimed in claim 6 and wherein the tear-away strip is defined between spaced lines of relative weakness in the outer surface of the tubular body.

8. A canister package as claimed in claim 6 and wherein the fold line is a line of weakening formed in the canister body prior to the tear-away strip being at least partially separated from the canister body.

9. A canister package as claimed in claim 7 and wherein the predetermined direction is substantially axial along the tubular body.

10. A canister package as claimed in claim 7 and further comprising a strip of tear tape secured to the tubular body and extending along the tear-away strip between the spaced lines of weakness.

11. A canister package as claimed in claim 10 and wherein the strip of tear tape is disposed on the inner surface of the tubular body.

12. A canister package as claimed in claim 11 and wherein the tear-away strip terminates in an exposed tab configured to be gripped by a user, the strip of tear tape extending onto the exposed tab.

13. A canister package as claimed in claim 7 and wherein the tear-away strip terminates in an exposed tab configured to be gripped by a user to facilitate tearing away the tear-away strip.

14. A canister package as claimed in claim 7 and wherein the lines of relative weakness comprise partial cuts.

15. A canister package as claimed in claim 14 and wherein the partial cuts are substantially 50 percent partial cuts.

16. A canister package as claimed in claim 6 and wherein the tubular body comprises paperboard.

17. A method of fabricating a canister package comprising the steps of:

(a) fabricating a blank having top and bottom edges and side edges and having a tear-away strip extending at least partially across the blank in a predetermined direction and at least one flap being positionable between a closed position wherein the at least one flap is adjacent the tear-away strip and an open position allowing access to the interior of the canister package upon tearing of tear-away strip, the blank further having partial cuts defined in the blank that extend transversely across the blank from the tear-away strip to a fold line, the least one flap being defined in the blank by the partial cuts and the fold line and being severable along the partial cuts when the tear-away strip is at least partially separated from the blank, the at least one flap limited in size by the fold line;

(b) forming the blank into a tubular body with the tear away strip accessible;

(c) closing one end of the tubular body with an end cap; and (d) closing the other end of the tubular body with an end cap.

18. The method of claim 17 and wherein step (a) comprises fabricating a blank from paperboard.

19. The method of claim 17 and wherein step (a) the predetermined direction comprises from substantially the top edge toward the bottom edge.

20. The method of claim 17 and where in step (a) the tear-away strip terminates at one end in a tab.

21. The method of claim 17 and where in step (a) the tear-away strip is defined between spaced lines of relative weakness.

22. The method of claim 21 and wherein step (a) further comprises disposing a strip of tear tape at least partially along the tear-away strip.

23. The method of claim 22 and wherein the tear tape is disposed on a side of the blank opposite the lines of relative weakness.

24. The method of claim 17 and wherein step (b) comprises rolling the blank in a direction from one side edge to the other side edge and securing the side edges together.

25. The canister package as claimed in claim 1 and wherein the at least one flap comprises a first flap and a second flap, the first flap being on one side of the tear-away strip and the second flap on the opposite side of the tear-away strip.

26. The canister package as claimed in claim 25 and wherein the fold line comprises a first fold line and a second fold line, the first flap is foldably connected to the canister body along the first fold line and the second flap is foldably connected to the canister body along the second fold line.

27. The canister package as clamed in claim 26 and wherein the canister body comprises partial cuts formed in the outer surface, the partial cuts extend transversely across the tear-away strip.

28. The canister package as claimed in claim 27 and wherein the partial cuts and the first fold line and the second fold line form the first flap and the second flap, each of the first flap and the second flap being severable along the partial cuts when the tear-away strip is removed.

29. The canister package as claimed in claim 1 and wherein the ends of the canister comprise a first end and a second end, the tear-away strip extends from the first end to the second end.

30. The canister package as claimed in claim 7 and wherein the substantially tubular body having partial cuts formed in the outer surface and the partial cuts extend transversely across the tear tape.

31. The canister package as claimed in claim 30 and wherein the substantially tubular body comprises one or more fold lines extending between corresponding ends of the partial cuts.

32. The canister package as claimed in 31 and wherein the one or more fold lines and the partial cuts form a generally orthogonal shape in the outer surface.

33. The canister package as claimed in claim 12 and wherein the exposed tab extends beyond one of the top end cap or bottom end cap.

* * * * *